US007575183B2

(12) United States Patent
D'Arrigo

(10) Patent No.: US 7,575,183 B2
(45) Date of Patent: Aug. 18, 2009

(54) VALVE BODY AND FLUID INJECTOR WITH VALVE BODY

(75) Inventor: Angelo D'Arrigo, Rosignano Solvay (IT)

(73) Assignee: Siemens VDO Automotive SPA, Fauglia/Pisa (IT)

( * ) Notice: Subject to any disclaimer, the term of this patent is extended or adjusted under 35 U.S.C. 154(b) by 0 days.

(21) Appl. No.: 10/596,689

(22) PCT Filed: Dec. 8, 2004

(86) PCT No.: PCT/EP2004/053354

§ 371 (c)(1),
(2), (4) Date: Feb. 20, 2007

(87) PCT Pub. No.: WO2005/061885

PCT Pub. Date: Jul. 7, 2005

(65) Prior Publication Data

US 2007/0290076 A1 Dec. 20, 2007

(30) Foreign Application Priority Data

Dec. 22, 2003 (EP) ..... 03029639

(51) Int. Cl.
*F02M 61/10* (2006.01)

(52) U.S. Cl. ..... 239/533.11; 239/533.9; 239/585.5

(58) Field of Classification Search ..... 239/533.11, 239/533.9, 533.2, 585.1–585.5, 88, 89, 91; 251/129.15, 129.21, 127
See application file for complete search history.

(56) References Cited

U.S. PATENT DOCUMENTS

| | | | | | |
|---|---|---|---|---|---|
| 4,215,820 | A | * | 8/1980 | Renger | 239/90 |
| 5,494,223 | A | * | 2/1996 | Hall et al. | 239/585.5 |
| 5,544,816 | A | * | 8/1996 | Nally et al. | 239/585.5 |
| 5,647,536 | A | * | 7/1997 | Yen et al. | 239/90 |
| 5,826,793 | A | * | 10/1998 | Askew | 239/124 |

FOREIGN PATENT DOCUMENTS

| | | |
|---|---|---|
| DE | 483 126 | 9/1929 |
| EP | 0 967 386 A2 | 12/1999 |
| GB | 2 112 455 A | 11/1982 |
| WO | 03/016707 A1 | 2/2003 |

OTHER PUBLICATIONS

International Search Report for Application No. PCT/EP2004/053354, 4 pages, Aug. 12, 2004.

* cited by examiner

*Primary Examiner*—Davis Hwu
(74) *Attorney, Agent, or Firm*—King & Spalding L.L.P.

(57) ABSTRACT

A fluid injector has a housing, an actuator unit and a valve body (2). The valve body (2) has a needle (22), which closes or opens a nozzle (213) depending on its position and comprises a guided zone (221). It further has a first part (21), which is arranged in a fixed position relative to the nozzle (213) and has a guided zone (215). It further has a second part (24), which has a first guide zone (242), that guides the guided zone (221) of the needle (22), and which has a second guide zone (243), that guides the guided zone (215) of the first part (21), with the second guide zone (242) having a greater diameter than the first guide zone (242).

8 Claims, 3 Drawing Sheets

VALVE BODY AND FLUID INJECTOR WITH VALVE BODY

CROSS-REFERENCE TO RELATED APPLICATIONS

This application is a U.S. national stage application of International Application No. PCT/EP2004/053354 filed Dec. 8, 2004, which designates the United States of America, and claims priority to European application number EP03029639.6 filed Dec. 22, 2003, the contents of which are hereby incorporated by reference in their entirety.

TECHNICAL FIELD

The invention relates to a valve body with a needle, which closes or opens a nozzle depending on its position and comprises a guided zone. The invention further relates to a fluid injector with an actuating unit, a housing and the valve body.

BACKGROUND

Fluid injectors, in particular fuel injectors for diesel or gasoline internal combustion engines, comprise a housing, an actuator unit and a valve body. The valve body comprises a needle that opens or closes a nozzle and in that way controls the injection of fuel. In an increasing number of applications actuator units with a piezoelectric actuator are used. They have the advantage of having a very fast response time to actuating signals and enable like that multiple injections into a cylinder of the internal combustion engine during one working cycle of the cylinder. In order to improve the spray characteristics of the fluid injector the fluid pressure is increased. In current gasoline internal combustion engines the fluid injectors are supplied with fuel which has a pressure of up to 200 bars.

WO 03/016707 A1 discloses a fluid injector with a connector to a fuel supply, a housing, an actuator unit, and a valve body. The housing is double tubed and has a recess, which takes up the actuator unit. The actuator unit comprises a piezoelectric actuator, which acts on the needle. Between the walls of the double tube-shaped housing the fuel is led from the connector to a fuel inlet of the valve body. The valve body has a housing part with a recess, that takes up a needle. Depending on the position of the needle a nozzle is opened or closed and respectively fuel is injected or not. In order to ensure a reliable operation of the valve body and the fluid injector the needle needs to be reliably guided in the valve body.

SUMMARY

The object of the invention is to create a valve body and a fluid injector with a valve body, which ensures a reliable guidance of a needle in the valve body.

EP 0 967 386 A2 discloses an outward opening fuel injector comprising a valve body and a needle, which closes or opens a nozzle depending on its position. The fuel injector comprises a spring abutment arrangement with a sleeve which is screw-threaded upon an end region of the needle. The spring abutment arrangement further comprises a guide region in the form of a sleeve which surrounds part of the needle. The diameter of the sleeve and the adjacent part of the needle is such as to ensure that fuel is only able to escape there at a restricted rate. The sleeve is slidable within a bore formed in a hollow cylindrical member. This hollow cylindrical member is received in a valve body. The sleeve further comprises a step in which an upper end of a spring engages. The spring extends axially parallel to the needle away from the sleeve.

DE 48 31 26 C discloses an injection valve with a needle and a cartridge, which guides the needle and which is pressed by means of a spring against an end of a housing of the fuel injector.

The object of the invention is to create a valve body and a fluid injector with a valve body, which ensures a reliable guidance of a needle in the valve body.

The invention is according to a first aspect distinguished by a valve body with a needle, which closes or opens a nozzle depending on its position and comprises a guided zone. The valve body further comprises a first part, which is arranged in a fixed position relative to the nozzle and comprises a guided zone. It further comprises a second part, which comprises a first guide zone, that guides the guided zone of the needle, and which comprises a second guide zone, that guides the guided zone of the first part, with the second guide zone having a greater diameter than the first guide zone. The second guide zone takes in the guided zone of the first part. This has the advantage, that the guided zone of the needle can be spaced far away from the nozzle, which gives freedom for the construction of the area closer to the nozzle. The second guide zone of the second part and the guided zone may be short in axial extension. The greater the diameter of the second guide zone is the shorter may be its axial extension without decrease in the quality in the guidance of the needle. Preferably the second part is during operation of the valve body in a fixed relative position to the needle.

In an advantageous embodiment of the first aspect of the invention the second guide zone of the second part has a smaller diameter than a free diameter of a return spring, that is arranged radially outwards from the second guide zone. The has the advantage that the valve body can be formed in a very compact way.

In a further advantageous embodiment of the first aspect of the invention the second part comprises a spring rest, where a return spring rests, which is arranged axially overlapping with the first guide zone. This has the effect that less parts are needed to assemble the valve body and therefore makes the valve body cheaper.

According to a second aspect the invention is further distinguished by a valve body with a needle which closes or opens a nozzle depending on its position and comprises a guided zone, a first part, which is arranged in a fixed position relative to the nozzle and comprises a guide zone. The valve body further comprises a second part, which comprises a first guide zone that guides the guided zone of the needle and which comprises a guided zone, that is guided by the guide zone of the first part, with the guide zone of the first part having a greater diameter than with the guide zone of the first part having a greater diameter than the first guide zone. This also has the advantage that the guided zone of the needle can be spaced far away from the nozzle which then gives additional freedom for the construction of the area closer to the nozzle. Further the guide zone of the first part and the guided zone of the second part may be short in axial extension. The greater the diameter of the guided zone of the first part is, the shorter may be its axial extension without a decrease in the quality of the guidance of the needle.

The second aspect of the invention is further distinguished by the second part comprising a spring rest, where a return spring rests. The guide zone of the first part has a smaller diameter than a free diameter of a return spring, that is arranged radially outwards from the guide zone of the first part. The return spring is arranged axially overlapping with the first guide zone. This has the advantage, that the valve body can be formed in a very compact way and that less parts are needed to assemble the valve body and therefore makes the valve body cheaper.

In a further advantageous embodiment of the valve body the guided zone of the needle and the first guide zone of the second part are located before a fluid inlet towards the needle in the direction of the nozzle. This has the advantage that there is no need for a throttling part for the fuel flow due to a guide zone in the second part and a matching guided zone of the needle. In that way the fuel may be led towards the throttle with a minimum of pressure losses due to throttling.

In a further advantageous embodiment of the valve body the first part forms the nozzle and takes in the needle. This has the advantage that the number of parts needed for the valve body is reduced and therefore the valve body may be produced more cheaply.

The invention is further distinguished by a fluid injector with a housing, an actuator unit and a valve body.

BRIEF DESCRIPTION OF THE DRAWINGS

Exemplary embodiments of the invention are explained in the following with the aid of schematic drawings. These are as follows.

Elements of the same design and function that occur in different illustrations are identified by the same reference character.

DETAILED DESCRIPTION

Figure 1:
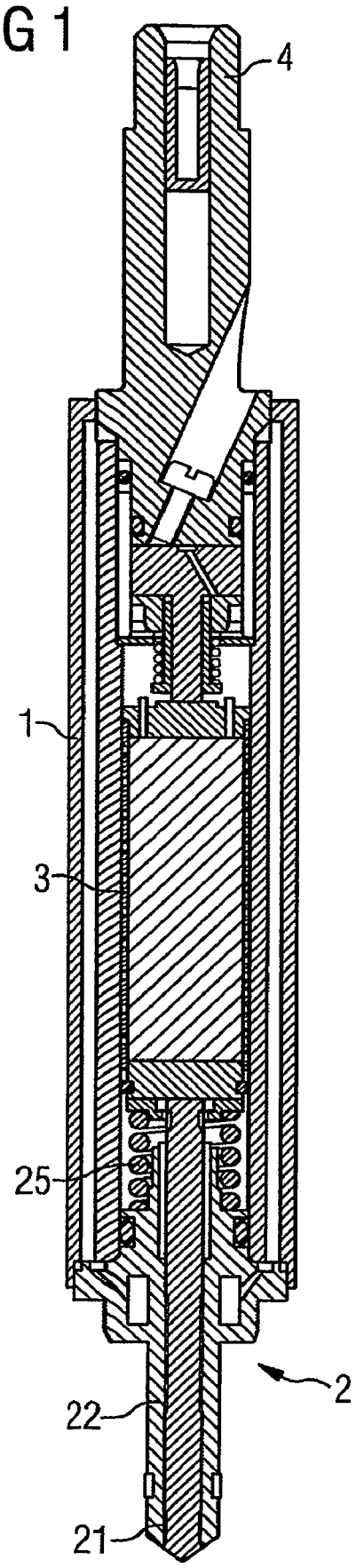
FIG. 1 a fuel injector with a valve body 2.
Figure 2:
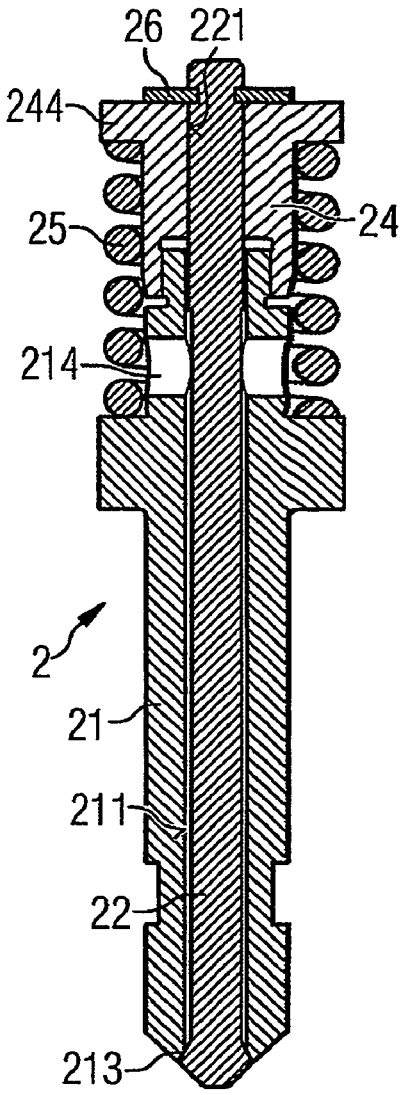
FIG. 2 the assembled valve body according to FIG. 1.
Figure 3:
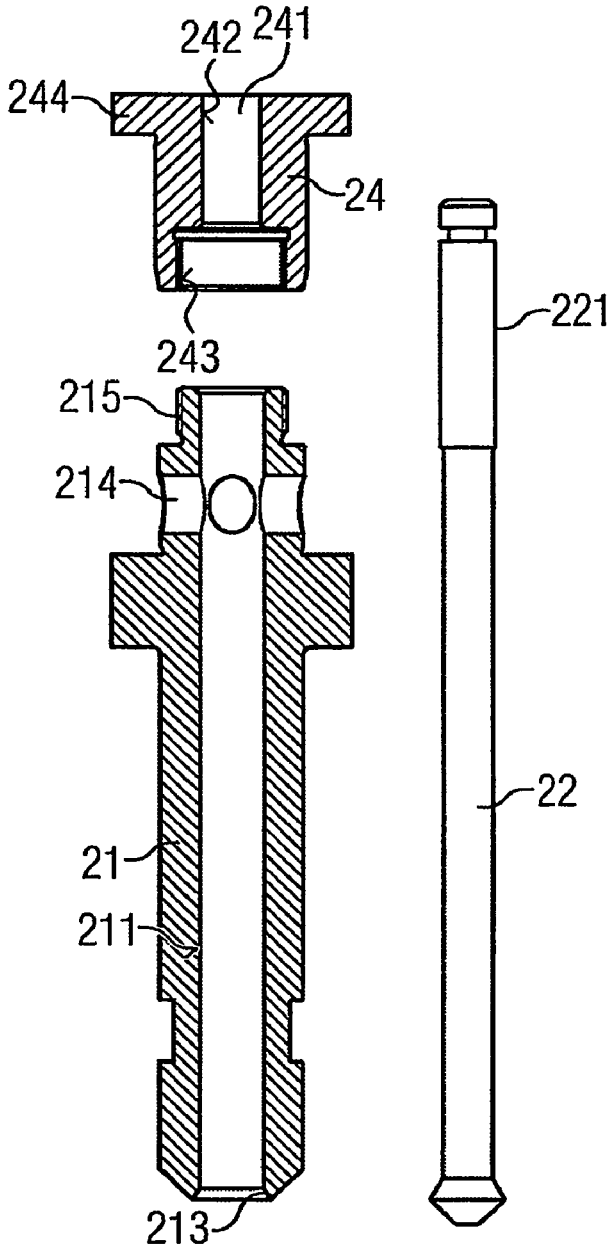
FIG. 3 a first and a second part 21, 24 and a needle 22 of the valve body 2, FIG. 4 an explosion representation of the valve body 2, FIG. 5 another representation of the valve body 2, and FIG. 6 a second embodiment of the valve body.

A fluid injector, which in this embodiment is a fuel injector (FIG. 1) of an internal combustion engine, is designed to be connected to a fuel supply via a fuel connector 4. The fuel supply preferably comprises a high pressure chamber, where fuel is stored under a pressure of up to 200 Bar. The fuel injector comprises a housing 1, a valve body 2, an actuator unit 3 and a fuel connector 4.

The housing 1 is formed in a double tubed manner. Between the walls of the double tubed housing 1 the fuel is led from the fuel connector 4 to the valve body 2. By this the fuel can be led to the valve body 2 in a substantially unthrottled way.

The valve body 2 is connected to a free end of the housing 1, preferably by welding. The valve body 2 comprises a needle 22, that is taken up in a recess 211 of the valve body 2 and which closes or opens a nozzle 213 depending on its position in the valve body 2 and in this way controls the fuel injection into a cylinder of the internal combustion engine. A return spring 25 pushes the needle 22 in the position, where the nozzle 213 is closed. The needle 22 is of an outward opening type, but it may also be of an inward opening type. The return spring 25 exerts a force on the needle 22 in the closing direction of the needle 22.

The needle 22 is coupled to the actuator unit 3. Depending on actuating signals the actuator unit 3 changes its axial length and by that pushes the needle 22 in its open position or leaves it in its closed position. The actuator unit 3 comprises a piezo actuator that is inserted in a tube spring, which pretensions the piezo actuator with a given force. A thermal compensator may be coupled with the actuator unit 3 and the housing 1 in order to compensate different thermal lengthening coefficients of the housing 1 and the actuator unit 3.

The valve body 2 comprises a first part 21, a second part 24, the return spring 25 and the needle 22. The first part 21 has the recess 211, into which the needle 22 is inserted and which at one of its ends forms the nozzle 213. The fuel is led from a fuel inlet 214 to the nozzle 213 in the space between the needle 22 and the walls of the recess 211 of the first part 21.

The second part 24 has a spring rest 244, where a return spring 25 rests. A spring retainer 26 limits the axial movement of the second part 24 in the direction of the actuator unit 3. The second part further comprises a recess 241 in which a first guide zone 242 is formed, that guides the needle 22 in the guided zone 221 of the needle 22. The second part 24 further comprises a second guide 243, which guides the first part 21 in a guided zone 215. The first and second guide zone 242, 243 are formed coaxially and the diameter of the second guide zone 243 is greater than the diameter of the first guide zone 242.

When the needle 22 moves in axial direction, the first part 21 stays in its position and the second part makes an axial movement corresponding to the axial movement of the needle 22. In this way there is a sliding movement between the first and the second part 21, 24 in the area of the second guide zone 243 and the guided zone 215 of the first part 21. The larger the diameter of the second guide zone 243 is, the shorter may be its axial extension without a decrease in the quality of the guidance of the needle 22. This is caused by the fact, that a contacting surface, where the second guide zone 243 contacts the guided zone 215 of the first part increases with an increasing diameter of the second guide zone 243. The quality of the guidance is influenced essentially by the size of this surface. Experiments have shown that the first guide zone 242 and the guided zone 221 of the needle 22 acting together with the second guide zone 243 and the guided zone 215 of the first part 21 have the effect, that even if the guided zone 221 of the needle 22 is located far away from the nozzle 213 the needle 22 is reliably guided without creating relevant oscillations of the needle in the radial direction. If the guided zone 221 of the needle and the first guide zone 242 of the second part are located before the fluid inlet 214 towards the needle 22 in the direction of the nozzle 213, there is no need for another guided zone of the needle in the area, where the fuel flows between the needle 22 and the wall of the recess of the first part 21.

Figure 4:
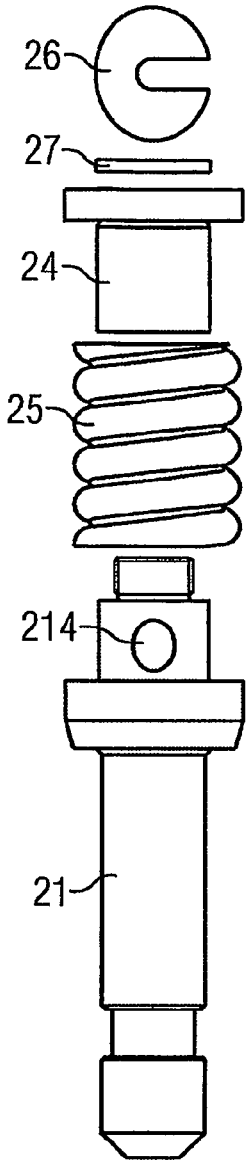
Figure 5:
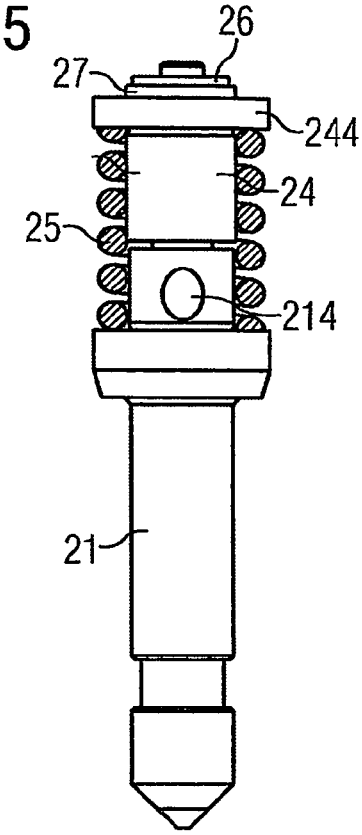

Preferably a calibrated shim 27 (FIG. 4) or more than one calibrated shim 27 are pushed on the needle between the retainer 26 and the spring rest 244 in order to precisely pretension the return spring 25.

Figure 6:
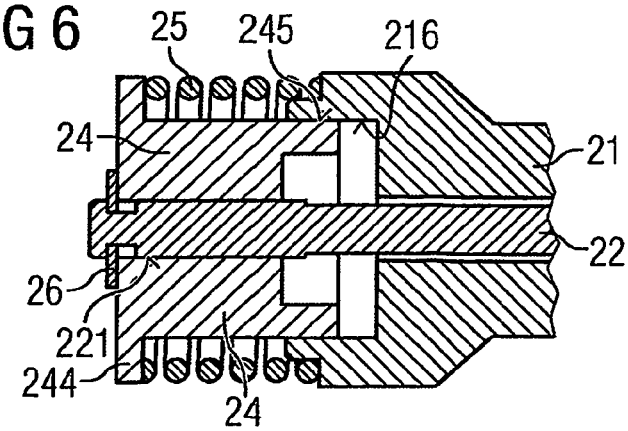

In a second embodiment of the valve body 2 (FIG. 6) there is a guided zone 245 on the second part 24 that acts together with a guide zone 216 of the first part 21. In this embodiment the first guide zone 221 of the second part 24 and the guided zone 242 on the needle 22 act together with the guided zone 245 of the second part 24 and the guide zone 216 of the first part 21. Also in this embodiment of the valve body 2 a reliable guidance of the needle 22 is ensured even if the guided zone 242 of the needle 25 is located relatively far away from the nozzle 213.

The invention claimed is:

1. A valve body comprising a needle, which closes or opens a nozzle depending on its position and comprises a guided zone, a first part, which is arranged in a fixed position relative to the nozzle and comprises a guided zone, and a second part which is arranged movably with respect to the nozzle, which comprises a first guide zone that guides the guided zone of the needle, wherein the second part comprises a second guide zone that guides the guided zone of the first part, with the second guide zone having a greater diameter than the first guide zone and taking in the guided zone of the first part, wherein the second guide zone has a smaller diameter than a free diameter of a return spring, that is arranged radially outwards from the second guide zone.

2. A valve body according to claim 1, wherein the second part comprises a spring rest, where a return spring rests, which is arranged axially overlapping with the first guide zone.

3. A valve body according to claim 1, wherein the guided zone of the needle and the first guide zone of the second part are located before a fluid inlet towards the needle in the direction of the nozzle.

4. A valve body according to claim 1, wherein the first guide zone is axially spaced to the second guide zone or respectively to the guided zone of the second part.

5. A valve body according to claim 4, wherein the first guide zone is axially further spaced apart from the nozzle than the second guide zone or respectively than the guided zone of the second part.

6. A valve body according to claim 1, wherein the first part forms the nozzle and takes in the needle.

7. A fluid injector with a housing, an actuator unit and a valve body according to claim 1.

8. A valve body comprising a needle, which closes or opens a nozzle depending on its position and comprises a guided zone, a first part, which is arranged in a fixed position relative to the nozzle and comprises a guided zone, and a second part which is arranged movably with respect to the nozzle, which comprises a first guide zone that guides the guided zone of the needle, wherein the second part comprises a second guide zone that guides the guided zone of the first part, with the second guide zone having a greater diameter than the first guide zone and taking in the guided zone of the first part, wherein the second guide zone has a smaller diameter than a free diameter of a return spring, that is arranged radially outwards from the second guide zone, and wherein the second part comprises a spring rest, where a return spring rests, which is arranged axially overlapping with the first guide zone.

* * * * *